US009765724B2

(12) United States Patent
Casoni et al.

(10) Patent No.: US 9,765,724 B2
(45) Date of Patent: Sep. 19, 2017

(54) FUEL INJECTED ENGINE SYSTEM

(71) Applicant: Walbro LLC, Tucson, AZ (US)

(72) Inventors: Massimo Casoni, Castelfranco Emilia (IT); William E. Galka, Caro, MI (US); Bradley J. Roche, Millington, MI (US); David L. Speirs, Cass City, MI (US); Mark S. Swanson, Cass City, MI (US); Eric G. Zbytowski, Caro, MI (US)

(73) Assignee: Walbro LLC, Tucson, AZ (US)

( * ) Notice: Subject to any disclaimer, the term of this patent is extended or adjusted under 35 U.S.C. 154(b) by 22 days.

(21) Appl. No.: 15/151,892

(22) Filed: May 11, 2016

(65) Prior Publication Data

US 2016/0252039 A1 Sep. 1, 2016

Related U.S. Application Data

(62) Division of application No. 13/590,500, filed on Aug. 21, 2012, now Pat. No. 9,371,786.
(Continued)

(51) Int. Cl.
*F02D 41/32* (2006.01)
*F02D 41/14* (2006.01)
(Continued)

(52) U.S. Cl.
CPC ..... *F02D 41/32* (2013.01); *F02D 9/1035* (2013.01); *F02D 31/003* (2013.01);
(Continued)

(58) Field of Classification Search
CPC .... F02D 41/32; F02D 41/062; F02D 41/1454; F02D 41/3082; F02D 41/14;
(Continued)

(56) References Cited

U.S. PATENT DOCUMENTS 4,508,075 A * 4/1985 Takao ..... F02D 41/1498 123/339.11
4,864,998 A * 9/1989 Onishi ..... F02D 41/04 123/494
(Continued)

FOREIGN PATENT DOCUMENTS

EP 1369572 A2 12/2003
JP 2006105063 A 4/2006

OTHER PUBLICATIONS

International Search Report and Written Opinion for corresponding international case No. PCT/US12/052184 dated Jan. 28, 2013, 10 pages.

*Primary Examiner* — Hieu T Vo
(74) *Attorney, Agent, or Firm* — Reising Ethington P.C.

(57) ABSTRACT

An engine system may include a fuel and air supply circuit and an exhaust circuit, a temperature sensor mounted on an exterior of the engine and an oxygen sensor located in the exhaust circuit. The fuel and air supply circuit may include a throttle body mounted on the engine and having a throttle valve to control the flow rate of air delivered to the engine, a fuel injector carried by the throttle body to deliver fuel to the engine and a fuel rail carried by at least one of the throttle body and the fuel injector and having an input to receive a supply of fuel and an outlet through which fuel is routed to the fuel injector. An engine control unit may be communicated with these components to control the fuel and air mixture provided to the engine as a function of the temperature and oxygen sensor outputs.

13 Claims, 6 Drawing Sheets

Related U.S. Application Data

(60) Provisional application No. 61/526,906, filed on Aug. 24, 2011.

(51) Int. Cl.

| | |
|---|---|
| ***F02M 35/10*** | (2006.01) |
| ***F02D 41/06*** | (2006.01) |
| ***F02D 41/30*** | (2006.01) |
| ***F02D 31/00*** | (2006.01) |
| ***F02M 35/16*** | (2006.01) |
| ***F02D 9/10*** | (2006.01) |
| ***F02M 69/50*** | (2006.01) |

(52) U.S. Cl.
CPC ..... *F02D 41/062* (2013.01); *F02D 41/1454* (2013.01); *F02D 41/3082* (2013.01); *F02M 35/10216* (2013.01); *F02M 35/162* (2013.01); *F02M 69/50* (2013.01); *F02D 2200/101* (2013.01); *Y10T 29/49233* (2015.01)

(58) Field of Classification Search
CPC ..... F02D 31/003; F02D 9/1035; F02D 2200/101; F02M 35/10216; F02M 35/10; F02M 35/162; F02M 69/50; Y01T 29/49233
See application file for complete search history.

(56) References Cited

U.S. PATENT DOCUMENTS

| | | | | |
|---|---|---|---|---|
| 5,088,464 | A | 2/1992 | Meaney | |
| 5,197,435 | A | 3/1993 | Mazur et al. | |
| 5,261,382 | A | 11/1993 | Nikolai | |
| 5,270,645 | A | 12/1993 | Wheeler et al. | |
| 5,979,412 | A | 11/1999 | Werner | |
| 6,151,547 | A | 11/2000 | Kumar et al. | |
| 6,202,626 | B1 | 3/2001 | Ito et al. | |
| 6,272,425 | B1 | 8/2001 | Herndon | |
| 6,672,570 | B2 | 1/2004 | Takano et al. | |
| 6,866,027 | B1 | 3/2005 | Marchesini et al. | |
| 7,000,595 | B2 | 2/2006 | Andersson et al. | |
| 7,040,282 | B2 | 5/2006 | Andersson et al. | |
| 7,100,576 | B2 * | 9/2006 | Kobayashi | F02D 41/10 123/478 |
| 7,198,028 | B2 | 4/2007 | Andersson et al. | |
| 7,448,358 | B2 | 11/2008 | Andersson et al. | |
| 7,735,471 | B2 | 6/2010 | Andersson et al. | |
| 8,382,072 | B1 | 2/2013 | Galka et al. | |
| 9,239,022 | B2 * | 1/2016 | Tsuji | F02D 29/02 |
| 9,371,786 | B2 * | 6/2016 | Casoni | F02D 41/062 |
| 2002/0043252 | A1 | 4/2002 | Suzuki et al. | |
| 2002/0053799 | A1 | 5/2002 | Brandt et al. | |
| 2002/0163183 | A1 | 11/2002 | Ooi et al. | |
| 2003/0094809 | A1 | 5/2003 | Inoue | |
| 2003/0132631 | A1 | 7/2003 | Nagata et al. | |
| 2004/0078134 | A1 | 4/2004 | Yin et al. | |
| 2005/0163192 | A1 | 7/2005 | Usui | |
| 2013/0298868 | A1 | 11/2013 | Wittkopf et al. | |
| 2013/0298871 | A1 | 11/2013 | Bennett et al. | |

* cited by examiner

FUEL INJECTED ENGINE SYSTEM

REFERENCE TO CO-PENDING APPLICATION

This application is a divisional of U.S. application Ser. No. 13/590,500, filed Aug. 21, 2012 which claims the benefit of U.S. Provisional Application No. 61/526,906 filed Aug. 24, 2011, both of which are incorporated herein by reference in their entirety. This U.S. application claims the benefit of both of these applications.

TECHNICAL FIELD

The present disclosure relates generally to an engine system and more particularly to a fuel injected engine system.

BACKGROUND

Fuel injection systems have been used in various applications using larger engines, such as automobiles. Fuel injection systems generally have not been used on smaller engine applications, because of the cost and complexity of traditional fuel injection systems. Instead, smaller engine applications like ATV's, scooters, mopeds and the like, continue to use carburetor-based fuel delivery systems.

SUMMARY

An engine system may include an engine having a fuel and air supply circuit and an exhaust circuit, a temperature sensor mounted on an exterior of the engine and an oxygen sensor located in the exhaust circuit and operable to provide a signal indicative of the oxygen content of engine exhaust gases. The fuel and air supply circuit may include a throttle body mounted on the engine and having a throttle valve to control the flow rate of air delivered to the engine, a fuel injector carried by the throttle body to deliver fuel to the engine and a fuel rail carried by at least one of the throttle body and the fuel injector and having an input to receive a supply of fuel and an outlet through which fuel is routed to the fuel injector. An engine control unit may be communicated with the temperature sensor, the oxygen sensor, the throttle valve and the fuel injector to control the fuel and air mixture provided to the engine as a function of the temperature sensor output and the oxygen sensor output.

In at least one implementation, an engine may include a main body and one or more cooling fins integrally formed on the main body. A temperature sensor may be coupled to a cooling fin by direct engagement of a portion of the temperature sensor with the cooling fin and without requiring any void formed in the cooling fin. And a clip having a first portion overlying part of the temperature sensor and a second portion overlying the cooling fin may be provided to trap the temperature sensor against the cooling fin. In this way, a signal representative of the operating temperature of the engine can be provided without having to modify the body of the engine (e.g. its head or block).

A throttle body assembly for use with an internal combustion engine may include a main body, a throttle valve and a fuel rail. The main body may include a throttle bore through which air is delivered to the engine, and a throttle valve may be carried by the throttle body. The throttle valve may be moveable between a first position substantially restricting air flow from the throttle bore and a second position permitting a greater flow rate of air from the throttle bore than the first position. The fuel rail may be carried by the throttle body so that the fuel rail can be oriented in a plurality of positions relative to the throttle body, the fuel rail having an inlet through which fuel is received and an outlet through which fuel is routed to a fuel injector. A retainer may be provided to secure the fuel rail to the throttle body and retain a desired orientation of the fuel rail.

A method of operating an engine used with a fuel system having an engine position or speed sensor and an ignition module may be utilized that detects engine rotation with the engine position or speed sensor, determines the time period for engine revolutions, compares the time period for one engine revolution to the time period of the previous engine revolution, and determines a compression stroke from an exhaust stroke based on the compared engine revolution time periods. The method may then include providing an ignition signal from the ignition module during the compression stroke and not during the exhaust stroke. One benefit to this method is that it saves energy otherwise wasted by providing an ignition signal during an engine exhaust stroke.

Another method of operating an engine used with a fuel system having an oxygen sensor and an engine control unit in communication with the exhaust sensor may also be utilized that provides a predetermined air/fuel mixture to the engine, provides a signal from the oxygen sensor to the engine control unit indicative of the oxygen content of exhaust gas discharged from the engine, adjusts the air/fuel mixture provided to the engine to achieve a signal from the oxygen sensor denoted lambda, and compares the actual air/fuel mixture needed to achieve lambda=1 to the predetermined air/fuel mixture to determine a correction value. The correction value may be utilized to alter the air/fuel mixture actually delivered to the engine from the predetermined air/fuel mixture for given operating conditions. Among other things, this may accommodate operating conditions not otherwise sensed, such as a restricted air flow (e.g. dirty air filter or other cause), change in barometric pressure, ambient air temperature, fuel type and the like.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
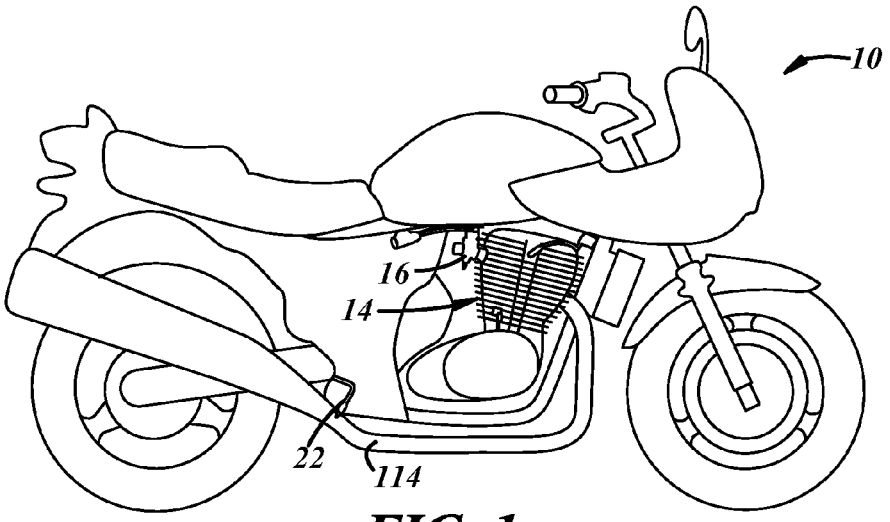
FIG. 1 illustrates a motorcycle that includes one implementation of a fuel system.
Figure 2:
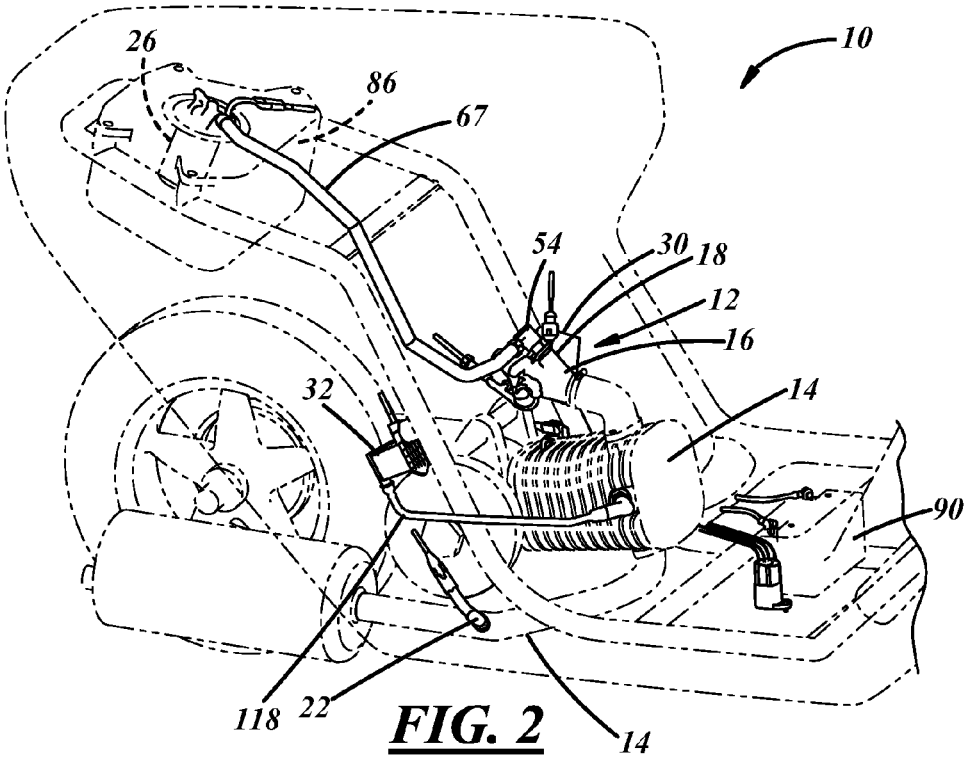
FIG. 2 is a partial view of an alternate fuel system shown assembled on an exemplary motorcycle or motor scooter.

Referring in more detail to the drawings, FIGS. 1 and 2 show a motorcycle 10 that includes exemplary embodiments of various components in a fuel injection system 12. The components and/or the system 12 as a whole may be used in a wide variety of engine applications, including relatively small engine applications like mopeds, scooters, small motorcycles, snow mobiles, personal watercraft, all terrain vehicles, marine engines, snow removal equipment, water pumps, pressure washers, and the like. In an exemplary implementation, the components can be used to retrofit with a fuel injection arrangement an engine designed to be used with a carburetor. In this way, a low-cost and efficient fuel injected engine can be provided for a wide range of applications.

Figure 3:
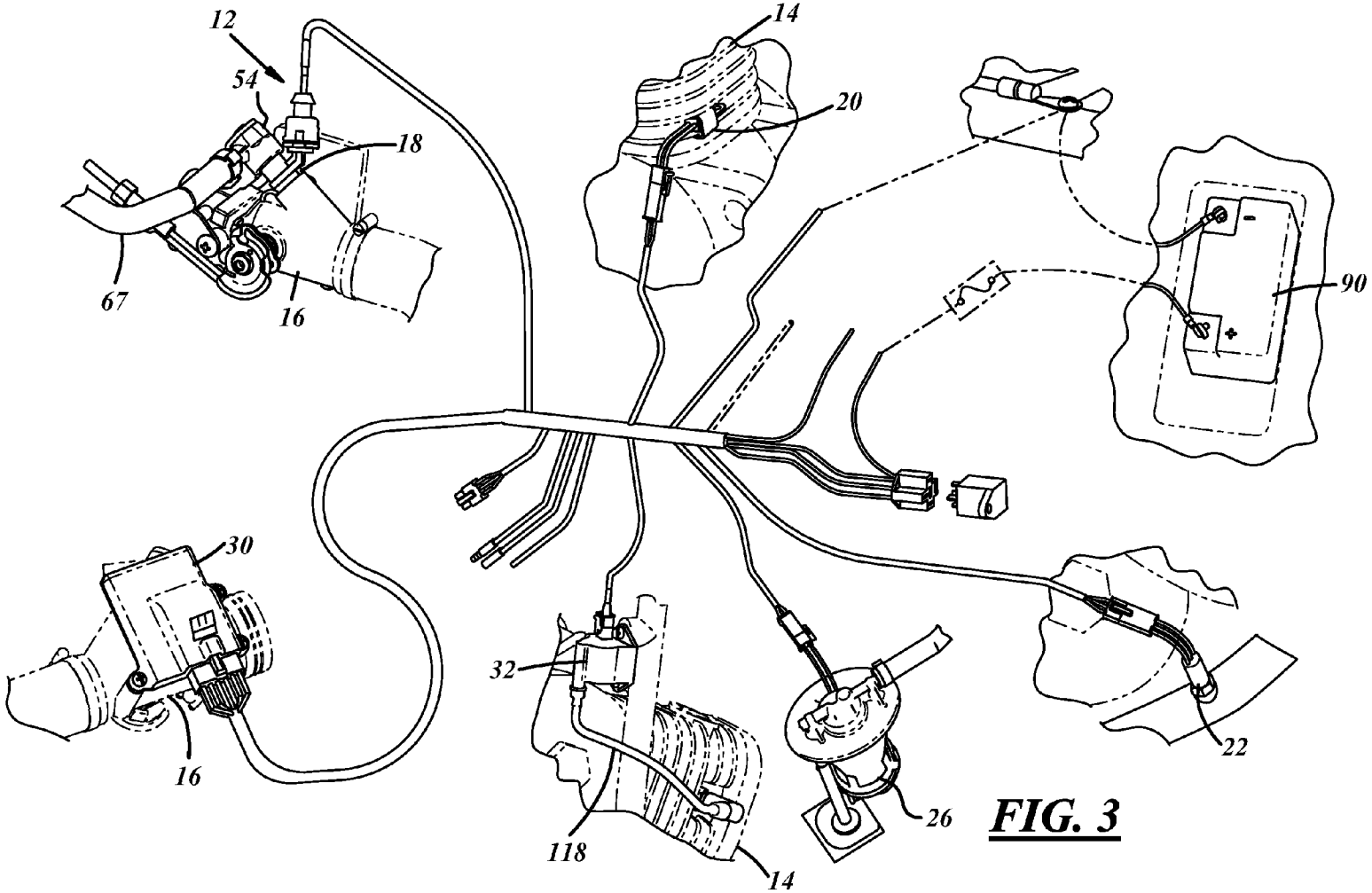
FIG. 3 is a fragmentary view of a wiring harness and components of the fuel system of FIG. 2.

In the exemplary implementation shown in FIGS. 1-3, the fuel system 12 may include a two or four-stroke engine 14 and a fuel and air delivery circuit that provides a combustible fuel and air mixture to an engine, an exhaust circuit that routes exhaust from the engine and one or more sensors that provide feedback indicative of engine operation or operating conditions. The fuel system 12 may include one or more of a throttle body 16, a fuel injector 18, an engine temperature sensor 20, an oxygen sensor 22, an engine position or speed sensor (not shown), a fuel pump 26, an engine control unit 30, and an ignition module 32. Desirably, these components may all be retrofitted, with minimal structural changes needed, to an engine 14 originally designed for use with a carburetor-based fuel system. In one form, the engine displacement may be between 50 cc and 250 cc, although other engine sizes may be used.

Figure 4:
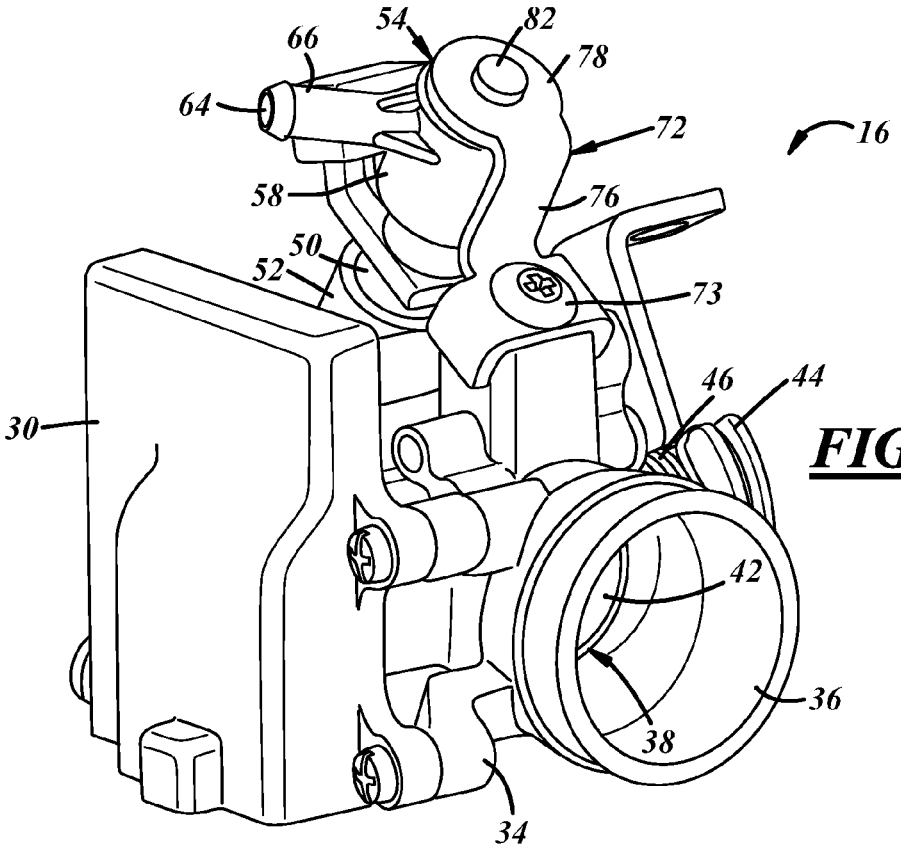
FIG. 4 is a first perspective view of a throttle body assembly.
Figure 5:
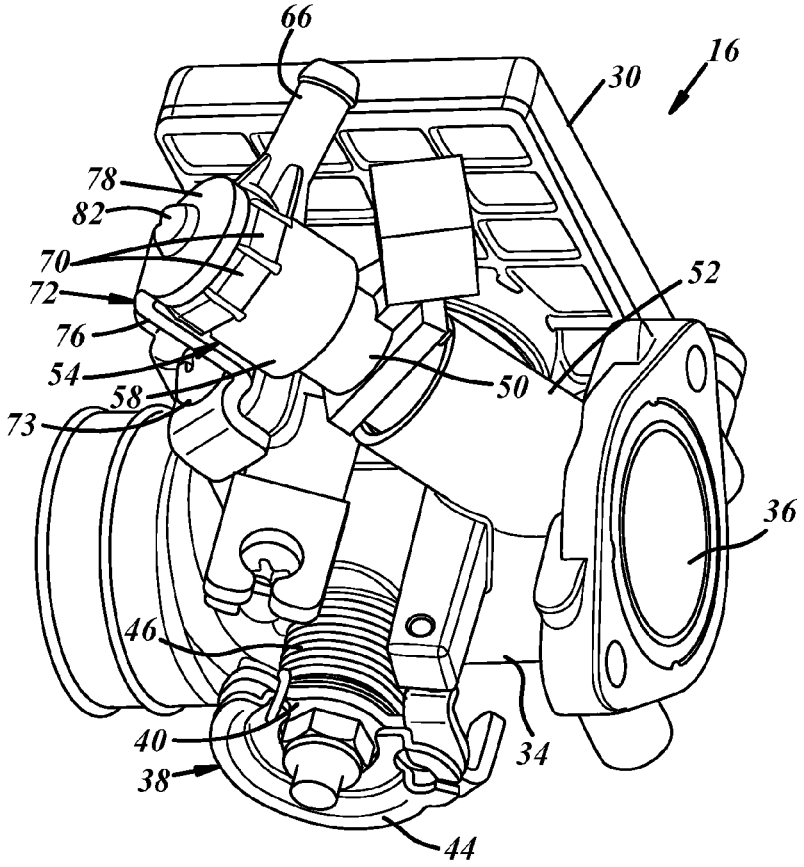
FIG. 5 is a second perspective view of the throttle body assembly.

As shown in FIGS. 4 and 5, the throttle body assembly 16 may include a main body 34 having a throttle bore 36 through which a regulated air flow is provided to the engine 14. A throttle valve 38 is associated with the throttle bore 36 to permit control of the flow rate of air delivered from the throttle bore 36. The throttle valve 38 may be a conventional butterfly type valve having a valve shaft 40 (FIG. 5) rotatably carried by the body 34 and a disc-shaped valve head 42 carried by the shaft 40 and rotatable relative to the throttle bore 36 as the shaft is rotated. The throttle valve 38 may be rotated between a first or idle position, providing a relatively high restriction to air flow through the throttle bore 36, and a second position which may be a wide open position providing relatively little restriction to air flow through the throttle bore. The throttle valve 38 may include an operating lever 44 carried by the valve shaft 40 and connected to a control (such as a throttle cable) to permit remote actuation of the throttle valve 38. A biasing member, such as a coil spring 46, may be associated with the throttle valve 38, and may provide a force on the operating lever 44, to yieldably bias the throttle valve to its idle position.

To provide fuel to the engine, a fuel injector 50 may be carried by the throttle body assembly 16. In one implementation, as shown in FIGS. 4 and 5, the fuel injector 50 is carried by the main body 34, such as by an appropriate bracket, a cavity 52 and/or other feature(s). The fuel injector 50 may receive fuel from a fuel rail 54 and provide fuel to the engine 14 in timed/controlled injection cycles. The fuel injector 50 may be a commercially available injector, such as the Deka VII Short Injector model, sold by SynerJect Corporation.

In one presently preferred form, the fuel rail 54 as shown in FIGS. 4-8, includes a one-piece body having a generally cylindrical portion 58 that includes a cavity 60 defining an outlet that plugs onto or is otherwise connected to the inlet of the fuel injector 50. A fluid seal may be provided by direct part-to-part contact, or a separate sealing member, such as an o-ring, may be provided between a shoulder 62 of the fuel rail 54 and an adjacent part of the fuel injector. The cavity 60 also communicates with an inlet passage 64 (FIG. 8) of the fuel rail 54. The inlet passage 64 may be defined at least in part by or in a nipple 66 extending from the cylindrical portion 58. The nipple 66 may receive a fuel supply hose 67 (FIGS. 2 and 3) extending from the fuel pump 26 to receive fuel from the fuel pump into the inlet passage 64.

Figure 6:
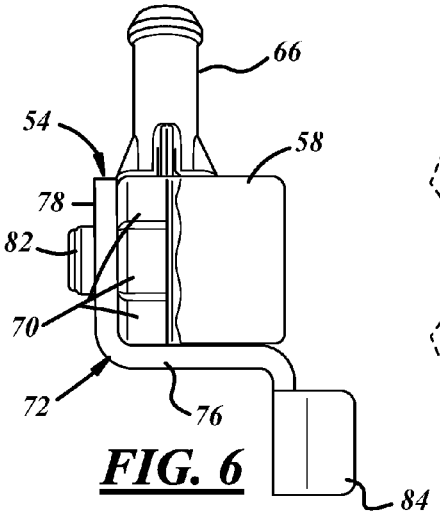
FIG. 6 is a side view of a fuel rail and bracket.
Figure 7:
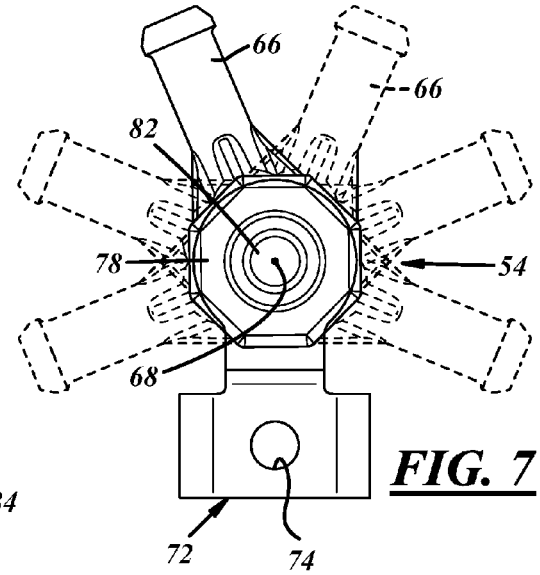
FIG. 7 is a top view of the fuel rail and bracket showing several alternate positions of the fuel rail.
Figure 8:
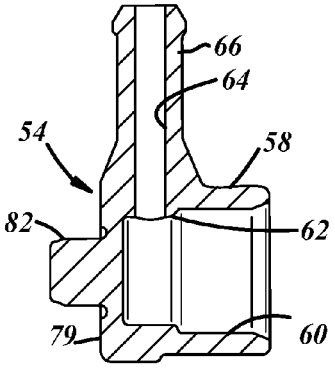
FIG. 8 is a sectional view of the fuel rail.
Figure 9:
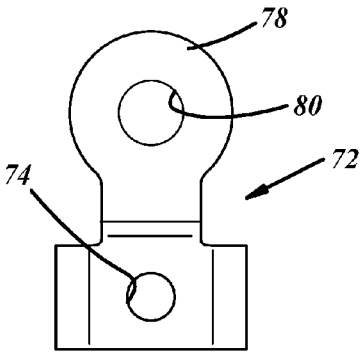
FIG. 9 is a top view of the bracket.
Figure 10:
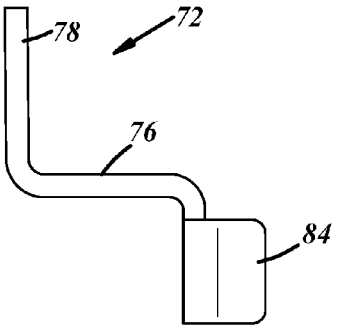
FIG. 10 is a side view of the bracket.
Figure 11:
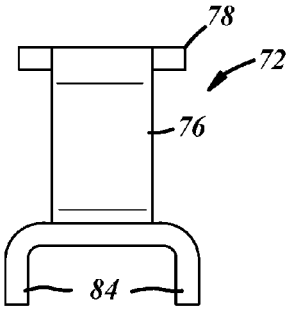
FIG. 11 is a rear view of the bracket.

The fuel rail 54, and hence the inlet nipple 66, may be movably positioned relative to the main body 34 to facilitate attachment of the fuel supply hose and use of the fuel rail 54 with a variety of engine designs. As best shown in FIGS. 6 and 7, the fuel rail 54 may be rotated or pivoted about an axis 68 to change the orientation of the inlet nipple 66. One or more anti-rotation features may be provided on or associated with the fuel rail 54 to limit or prevent rotation of the fuel rail after assembly. The anti-rotation features may include one or more flat surfaces 70 formed on a periphery of the fuel rail body 56, where the flat surfaces 70 are designed to engage an adjacent surface. In one form, the adjacent surface may be part of the main body 34, or it may be part of a bracket 72 (FIGS. 9-11) used to retain the fuel rail 54. The bracket 72 may be fixed to the main body 34, such as by a fastener 73 received through an opening 74 in the bracket, and it may have a finger 76 that extends adjacent to the flat surfaces 70 to retain the circumferential position of the fuel rail 54. The axial position of the fuel rail 54 may be retained by a bent end 78 of the finger 76 that overlies an upper surface 79 (FIG. 8) of the fuel rail 54. The end 78 may include an opening 80 received over a cylindrical knob 82 extending from the upper surface 79. The end 78 may be press-fit over the knob 82 to securely retain the axial position of the fuel rail 54 relative to the fuel injector 50 and main body 34. The axis or centerline of the knob 82 may coincide with the axis 68 of rotation of the fuel rail 54, which may coincide with a centerline of the cavity 60 and the inlet of the fuel injector 50 to ensure alignment of the fuel rail 54 and fuel injector 50. The bracket 72 may include spaced apart base flanges 84 that, in assembly, lie on either side of or against complementary surfaces of the throttle body 34 to prevent rotation of the bracket 72 and permit secure connection of the bracket 72 to the throttle body 34 at only one point of connection (e.g. with only a single fastener). This reduces cost and assembly time and effort while providing a robust connection of the fuel rail 54 to the injector 50 and the throttle body 34. The bracket 72 may be made of any suitable metal or plastic material.

Fuel may be provided to the fuel injector 50 by any suitable fuel pump 26. The fuel pump 26 may be located within a fuel tank 86 (FIG. 2) or outside of the fuel tank. The fuel pump 26 takes in fuel from the fuel tank 86 and delivers the fuel under pressure to the fuel injector 50 through the hose 67 and fuel rail 54. The fuel pump 26 preferably is driven by an electric motor, and may be of any suitable type, such as, for example, an impeller or gerotor type fuel pump which may be as generally disclosed in U.S. Pat. Nos. 6,547,515 and 5,219,277. The disclosures of these patents are each incorporated herein by reference in their entirety.

The fuel pump 26 may be driven at a variable rate to provide a specified pressure or flow rate of fuel to the fuel injector 50, or a fuel pressure regulator may be used to provide a desired pressure of fuel to the fuel injector.

Figure 12:
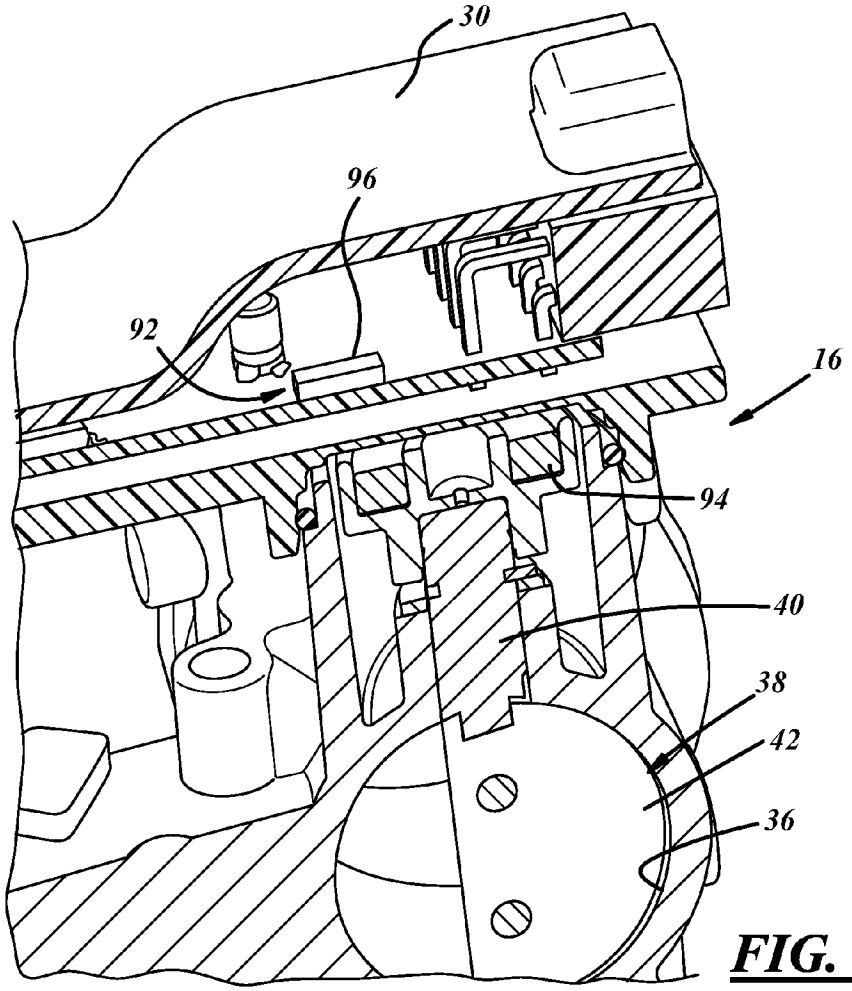
FIG. 12 is fragmentary sectional view of the throttle body assembly showing a throttle valve and a throttle valve position sensor.

The throttle body assembly 16 may also include or carry the engine control unit 30. The control unit 30 may include or communicate with a throttle valve position sensor 92. The throttle position sensor 92 may be a non-contact type sensor including a magnet 94 and an electronic sensor 96 responsive to the rotary position of the magnet 94 to determine the rotary position of the throttle valve 38, as shown in FIG. 12. One such throttle position sensor is disclosed in U.S. patent application Ser. No. 12/739,787 filed on Apr. 26, 2010. This application is incorporated by reference, herein in its entirety. The control unit 30 may also communicate with the engine temperature sensor 20, the exhaust gas oxygen sensor 22, and the engine position sensor 24 that determines engine speed and position. As a function of these inputs, the control unit 30 may control, at least in part, an engine relay (which may switch on/off power to the fuel pump 26, oxygen sensor 22, and fuel injector 50), operation of the fuel injector (to vary the flow rate/quantity of fuel supplied from the injector) and engine ignition (such as by control of an ignition signal provided to a spark plug).

Figure 13:
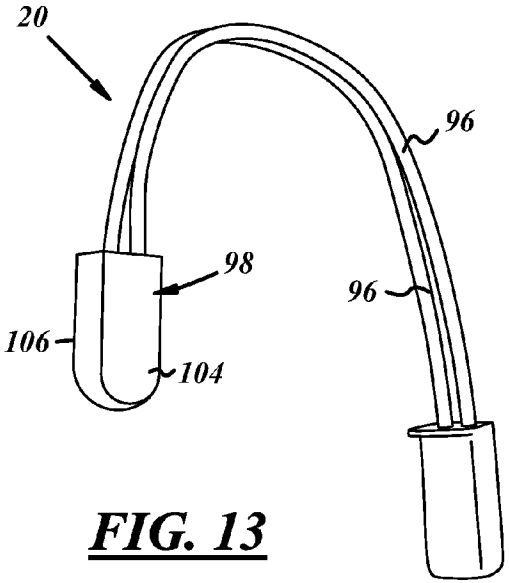
FIG. 13 is a perspective view of a temperature sensor.
Figure 14:
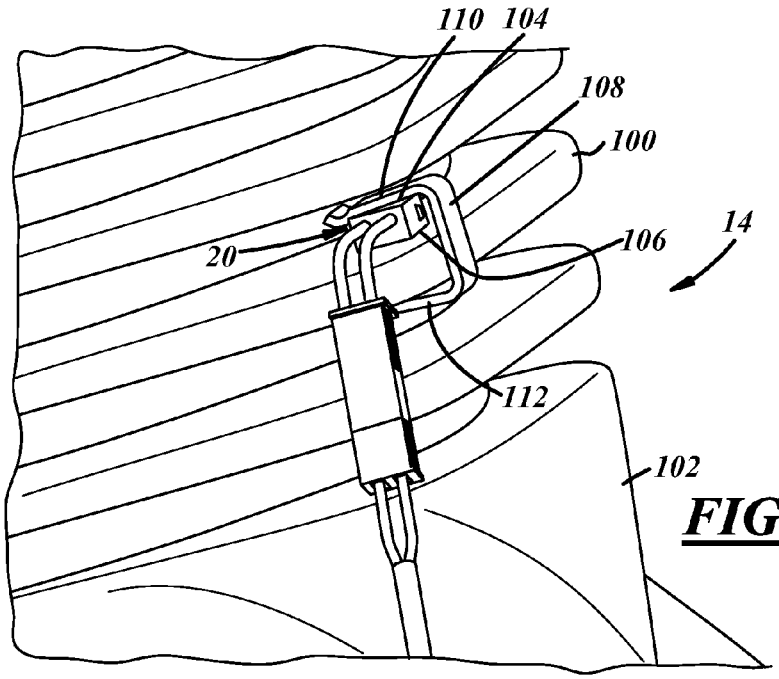
FIG. 14 is a fragmentary perspective view of the temperature sensor mounted on an engine.

In one presently preferred form, the engine temperature sensor 20 may be a negative temperature coefficient thermistor type sensor, such as a model SJ1626 that is sold by Therm-O-Disc corporation of Muskegon, Mich., USA. The temperature sensor 20 as shown in FIGS. 3, 13 and 14, may include two lead wires 96 connected at a junction which may be covered by a glass bead (not shown). The junction and glass bead may also be enclosed in a cover 98, if desired. The cover 98 may be overmolded onto the glass bead and a portion of the lead wires 96, or the cover 98 may be separately formed and disposed over the glass bead and adjacent portion of the lead wires 96 and may be filled with an epoxy or potting material. An output from the temperature sensor 20 may be provided to the engine control unit 30 for feedback control of the air and fuel mixture provided to the engine 14.

The engine temperature sensor 20 may be adapted to be mounted on or near an exterior of the engine 14. In one form, the engine temperature sensor 20 is mounted to a cooling fin 100 of an engine block casting 102. The cover 98 of the engine temperature sensor may have generally planar upper and lower surfaces 104, 106 and may be mounted to the fin 100 by a profiled or c-shaped clip 108 that holds the temperature sensor 20 onto the fin 100 under a compression force. This may hold the temperature sensor 20 firmly and flatly against the engine surface to which it is mounted (a cooling fin in the noted example) to provide good surface area contact for more accurate and responsive temperature measurement. The clip 108 may be formed of a resilient metal or other material suitable for use in the elevated temperature environment near the engine. The clip 108 may have one finger 110 that engages the upper surface 104 of the cover 98 and another finger 112 disposed under the cooling fin 100 to trap the temperature sensor 20 flush against the cooling fin 100, with the ends of the fingers 110, 112 being flexible and resilient to provide a clamping force on the sensor 20 and cooling fin 100. The clip 108 permits the temperature sensor 20 to be mounted to the engine 14 without any alteration or modification of the engine block casting 102 or fin 100, such as a hole, slot or other void which may be required for other fasteners or sensors (e.g. sensors mounted by threaded fasteners, or sensors including a threaded portion). Further, the cooling fins of most engines of this type are readily accessible so the temperature sensor 20 can be mounted with little cost or assembly effort. Of course, the sensor 20 could be mounted to the engine 14 in any other suitable way, including by a screw, rivet, adhesive, or other fastener or connector. Further, the engine temperature sensor 20 can readily be mounted in a consistent location from engine-to-engine, and even on different engines as most engines of this type have similar cooling fin arrangements.

The exhaust gas oxygen sensor 22 may be communicated with an exhaust manifold or exhaust pipe 114, as shown in FIGS. 1 and 2, through which exhaust gases are routed from the engine 14. The oxygen sensor 22 may be a titania type oxygen sensor, which is a resistive type sensor, such as that sold by Standard Motor Products of Long Island City, N.Y. The oxygen sensor 22 may be mounted in an opening provided in the manifold or pipe 114, and may include appropriate threads or other connection feature to facilitate retention of the sensor 22 in use. In at least some applications, the sensor 22 may be threaded into a nut or boss welded or incorporated in or on the exhaust pipe 114, and may be located ahead of or in front of the exhaust muffler or catalyst element as shown in FIGS. 1 and 2. The oxygen sensor 22 may provide a signal to the engine control unit 30 indicative of the oxygen content of the engine exhaust gas. Such a signal is used by the engine control unit 30 to control the air and fuel mixture that is provided to the engine 14.

The supply voltage to the oxygen sensor 22 may vary, especially in relatively small engine vehicles where voltage regulation may not be as good as in more sophisticated systems like that in automotive vehicles. To compensate for changes in the supply voltage to the oxygen sensor 22, the engine control unit 30 may include a microprocessor that adjusts the output signal of the oxygen sensor 22 as a function of the input voltage provided to the oxygen sensor 22. In this way, changes in the supply voltage do not significantly affect the output of the oxygen sensor 22 and a more reliable indication of the oxygen content of the exhaust gas can be obtained. The adjustment needed to be made can be determined empirically for a given vehicle/engine and sensor combination, or based on data for a particular sensor such as may be provided by the sensor manufacturer. While a titania sensor is presently preferred, other oxygen sensors may be used, including zirconia-type sensors.

Temperature and the supply voltage can influence the operation of resistive oxygen sensors. To offset the potential temperature effect a heater element may be provided with or as part of the sensor 22. The heater helps initial warm-up and possible signal drop out during extended idling periods. Additionally, in at least some applications, it may be desirable to position the oxygen sensor 22 in a location that will permit the sensor or surrounding area to reach a minimum temperature value (i.e. the temperature needed for consistent or proper operation of the sensor).

The system may use a capacitive discharge ignition (CDI) system. In one form, the CDI system may utilize a vehicle battery 90 (FIGS. 2 and 3) to charge an ignition capacitor, and magnets on the flywheel and adjacent inductive coils may be used to charge the battery. In another form, one or more inductive coils are used to charge the ignition capacitor. The CDI system may be driven by the engine control unit 30, and the engine control unit 30 may be responsive to engine position and speed, as well as engine temperature and exhaust gas oxygen content to control and/or vary ignition time.

Figure 15:
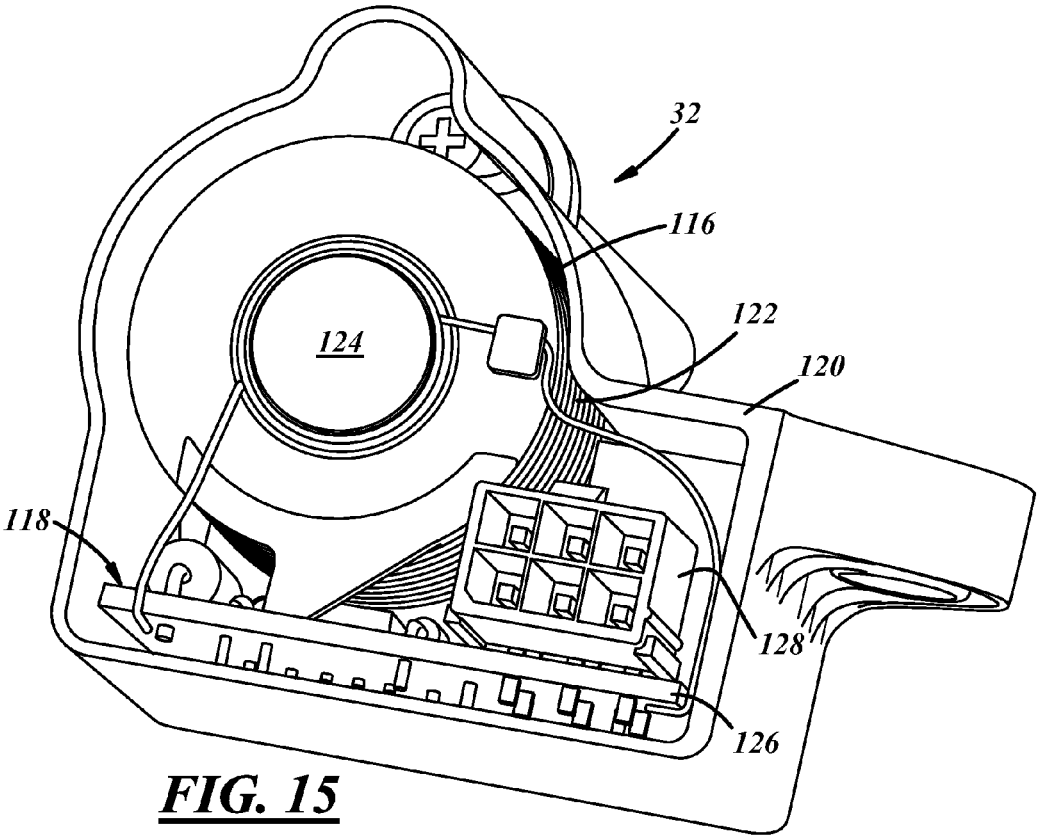
FIG. 15 is a perspective view of an ignition module with a cover removed and without any potting or other material in a housing of the module to show components within the housing.

The system may also include the ignition module 32 having an ignition coil 116 that provides a spark signal to a spark plug through a wire 117 (FIGS. 2 and 3) to initiate the combustion of fuel and air in the engine combustion chamber. As shown in FIG. 15, the ignition coil 116 may be carried in a housing 120 mounted to the vehicle or its engine 14. The ignition coil 116 may include a driver circuit 118 to "fire" the ignition coil 116 and hence, cause the spark plug to generate a spark for combustion. The driver circuit 118 may be communicated with the engine control unit 30 which may ultimately control the timing of the ignition event. The coil 116 may include a wire 122 wound around a core 124, as is known in the art. The wire 122 may have its ends coupled to a circuit board 126 of the driver circuit 118. An electrical connector 128 may also be coupled to the circuit board 126 and is adapted to receive a complementary connector of a wiring harness that communicates the driver circuit 118 with the engine control unit 30. In this way, a signal from the engine control unit 30 can be sent to the driver circuit 118 and the driver circuit 118 can generate an ignition signal that is sent to the spark plug through the ignition coil 116 and the spark plug wire 117.

During engine starting and warm-up, or turning a key or other switch to an "on" position, power is provided to the ECU 30 and its microprocessor is booted up. The ECU may then activate the engine relay control (ERC) to supply power from the battery to the fuel pump 26, fuel injector 50, and the oxygen sensor 22. Upon provision of power to the ECU 30, its microprocessor is booted up and, once the microprocessor is operating, an initial reading of sensor inputs is performed.

The engine sensor 24 may include a bistable circuit with hysteresis that may be integrated in the ECU 30 to determine the engine crankshaft position, and this determination preferably is based on data from the existing engine crankshaft position sensor. This circuit allows the reliable measurement of the leading edge of a raised tooth on a stock or conventional flywheel to calculate the crankshaft speed and position. In this way, no modification to the engine 14 and little or no modification to the flywheel is needed (may need minor change to flywheel to allow for more offset, so a change in keyway location or some other simple modification may be needed), which eliminates the necessity of a more expensive crankshaft position sensor and a multi-tooth wheel attached to the flywheel, or an otherwise modified flywheel. Upon initial activation, the fuel pump 26 will run for a specified time period unless the engine position sensor 24 provides a signal that the engine 14 is rotating. This initial period of time is set to ensure that fuel is being pumped to the engine 14 for a sufficient time period to support starting the engine 14. However, the longer the time period for which the fuel pump 26 is activated without the engine rotating, the more energy is wasted in pumping fuel that is not being used by the engine 14. Accordingly, the time period may be set for some reasonable length of time to let the operator start the engine 14, but not for so long that significant energy is wasted if, for example, attempts to start the engine 14 are ceased. In one example, the initial time period is set to 20 to 30 seconds, although any desired time period may be used. That is, the fuel pump 26 will pump fuel for 20 to 30 seconds upon initial activation and in the absence of a signal from the engine sensor 24 indicating that the engine is rotating. If there is a signal indicating that the engine 14 is rotating, then the fuel pump 26 will be operated until no signal is present to support engine operation.

When the oxygen sensor 22 is powered, its heater element begins to warm-up. Like the fuel pump 26, the heater element may be powered for an initial period without engine rotation and after that initial period, the heater will not be powered in the absence of engine rotation. The initial period of time may also be set at 20 to 30 seconds, or any other desired time period.

Once the engine sensor signal is detected, the ECU 30 performs all the calculations and look-ups to properly activate the fuel injector 50 and ignition module 32. Proper fuel injector duration and spark timing signal are determined from engine temperature, engine speed, throttle position, rate of change in throttle position, time and or engine revolution number and oxygen sensor signal. During initial warm-up of a cold engine, fuel injector duration may be modified to supply additional fuel based on engine temperature and number of engine revolutions. A calibration table, algorithm or other source of engine temperature vs. fuel enrichment data or information may be used to enable adjustment of the flow rate of fuel delivered to the engine so the engine will be provided with a richer than normal air/fuel mixture, such as approximately lambda=0.85. The rich air/fuel mixture may facilitate starting and initial running and warming up of the engine. During this warm-up phase, the engine may be in "open loop" control since the oxygen sensor signal might not be usable at this time because the oxygen sensor 22 may take a certain amount of time to heat up and reach a stable temperature.

As the engine warms-up the richness of the fuel and air mixture supplied to the engine can be decreased according to the enrichment table or other data source. Once a predefined calibrated engine temperature value and/or elapsed time of engine running are reached, the oxygen sensor 22 will have been sufficiently warmed-up to provide a desirably stable and reliable output. At that time, the engine 14 could be switched to "closed loop" control and the signal from the oxygen sensor 22 would be used to try and maintain a desired fuel to air mixture ratio, such as Lambda=1. The second part of the engine enrichment is derived from calibration planes determined as a function of two inputs, engine temp and engine revolutions to determine an output, which is an enrichment value. In one implementation, the calibration plane or value includes a temperature range of between −30° C. and 100° C., but a different range could be used. The calibration plane also includes 200 revolutions of the engine, although more or fewer revolutions could be accounted for. Accordingly, based on the temperature and the number of engine revolutions, an enrichment value is provided by the calibration plane to determine an amount of fuel enrichment, if any, desired for a given situation. During engine cranking and the very initial engine operating time period, the calibration enrichment plane is used to modify the fuel injector operation and hence, the fuel to air mixture ratio. One reason for doing this is to aid starting and initial running of the engine by wetting the intake manifold wall more quickly. The enrichment value may decrease quickly to zero over a relatively short number of engine revolutions, for example, the number of engine revolutions may be between about 50 and 500, although other values may be used as desired.

Once the engine is started, the engine speed increases from an initial cranking speed towards idle speed. As the engine speed reaches a minimum threshold value and the throttle position is within an idle speed control threshold (that is, the throttle valve is at idle or within a threshold distance off idle) the ignition timing will be advanced or retarded to try and bring the engine speed within the idle speed control range. There may be an upper RPM threshold that prevents the idle speed control from being implemented when the engine is at too high of a speed (for example, when the engine is returning to idle from high-speed operation). This prevents the idle control from trying to control engine speed before it is needed (or perhaps even possible). For an engine that idles at 1,700 rpm, the upper RPM threshold may be higher than that, and may be, by way of a non-limiting example, 1900 rpm. There may also be a lower RPM threshold to prevent idle control when, for example, the engine is being initially cranked or started. If the cranking speed is 600 rpm, the lower RPM threshold may be higher than that, and may be, by way of a non-limiting example, 700 rpm. In addition or instead of the upper RPM threshold, an upper throttle position threshold may be used to limit use of the idle control based on throttle position. If the throttle valve is normally 7% open at idle, then the upper throttle position threshold may be higher than that, and may be, by way of a non-limiting example, 10% so that idle control does not occur when the throttle valve is open more than 10%.

In one implementation, idle speed feedback control is operational as long as the two input conditions of engine speed and throttle position are met (that is, these conditions are within the set thresholds). Limits are placed on the amount of ignition timing both maximum advance and minimum advance (retard). The fuel injector operation may be changed to help bring the idle speed within the desired range if, for example, the ignition timing is operating at its maximum or minimum value for longer than a specified time period.

Once the engine rotation is detected a test may be performed based on the engine position sensor signal. The time period in seconds between engine position sensor signals (engine revolutions) is measured and compared to the previous revolution's time period. This effectively measures the time period of one complete engine revolution and compares it to the time period of a previous revolution. The revolution with the smaller time period should be the engine revolution containing the exhaust stroke since there is no work performed from the compression stroke. This test is continuously performed until a predetermined number of consecutive cycles yields the same engine revolution to be shorter in time period than the other cycle. The number of consecutive cycles can be set to any desired value, and in one presently preferred implementation, is 20 cycles. Once the required number of consecutive correct tests is accomplished the ECU 30 will stop sending an ignition signal for the exhaust stroke and ignition will only occur during the compression stroke. Likewise, the fuel injection event will also be phased and occur only once per 2 engine revolutions. This phasing of the ECU 30 will reduce the electrical consumption of the EFI system 10 and produce both better engine operation and lower exhaust emissions. Since there is only one signal from the engine position sensor 24 per engine revolution, this time period is very susceptible to influences from normal cycle-to-cycle combustion events. A possible refinement in this test would be to measure the time period for or length of a signal generated by the flywheel tooth used to determine engine speed passing by the engine speed sensor, and also the time period of the full engine revolution. Comparing these two signals will provide the needed input to determine proper phasing, where the length of the signal provided by the tooth passing the sensor will be shorter during faster revolutions than during slower revolutions.

After the engine has been started and sufficiently warmed-up, for maximum catalyst efficiency in at least some systems, it may be desirable to operate the air/fuel ratio very close to Lambda=1. Additionally, it may be desirable to have some oscillation in the air/fuel ratio such as on the order of Lambda=1.03 to 0.97 at a frequency of 2 Hz. The optimal amplitude and frequency may be optimized for a given engine application. The method of oscillating the air/fuel ratio value could also be changed. For example, a linear approach may be used at a fixed clock rate. Other alternatives such as a step and linear approach or a variable clock rate based on engine speed may provide improved control during transients and steady state operations. Varying between lean and enriched air/fuel ratios can improve the efficiency of an exhaust catalyst. Leaner air/fuel ratios provide excess oxygen that is beneficial for oxidation of CO and HC, but which can reduce conversion of $NO_x$ to $N_2$. Richer air/fuel ratios facilitate conversion of $NO_x$, but do not provide the excess oxygen for oxidation of CO and HC.

Empirical or calculated data may be used to provide a base fuel and ignition timing map to operate the engine at Lambda=1 during steady state operation on a fully warmed-up engine. That is, the fuel injector operation and ignition timing may be controlled based on data from engine calibration tests. Additionally, the fuel injection pulsewidth may be modified based on a correction value "K" which helps to account for such variables and conditions for which sensor feedback is not available or not used in a given application. Non-limiting examples include barometric pressure, air temperature, fuel type (and, for example, alcohol content) or a dirty air filter. The correction value "K" may be calculated based on the base map fuel injector pulsewidth and the actual operating pulsewidth for any operating condition of throttle position and engine speed. That is, the "K" value may be the difference between the fuel the base map calibration suggests is needed to provide a desired Lambda value and the actual fuel that is needed to provide that desired Lambda value (based on feedback from the oxygen sensor).

Acceleration/Deceleration transitions may be corrected based on one or more calibration planes. In one implementation, two planes may be used for fuel injector duration and two planes may be used for ignition timing. Acceleration events may be controlled with the acceleration planes based on throttle position rate changes and engine speed at which the acceleration occurred. The same is true for deceleration. The correction value K within the acceleration/deceleration plane may be used in conjunction with a decay value. This combination will modify the pulsewidth and linearly decay the correction value over a specified number of engine revolutions so that the fuel delivery returns to normal after a certain amount of time after acceleration or deceleration events. A possible refinement may be to provide a non-linear decay rate that more closely tracks a given engine's requirements after acceleration or deceleration events to improve engine performance. Another possible refinement is to "freeze" the "K" value during the decay time period, if desired, to reduce inaccuracies that may result in oxygen sensing during high transient (acceleration/deceleration) conditions.

Engine overspeed protection may be provided by skipping either or both fuel injection and ignition events above a specified engine speed. The engine speed at which overspeed protection is enabled can vary by engine. Representative engine speeds at which overspeed protection might be enabled are 7,000 rpm to 10,000 rpm. Of course, higher and lower values may be used, as desired.

The oxygen sensor signal has an output voltage that corresponds to rich and lean air/fuel ratios. A rich air/fuel ratio may be indicated by a relatively high sensor signal such as 0.6 volts or greater, while a lean air fuel ratio may be indicated by a lower sensor signal such as 0.3 volts or lower. The noted voltages are exemplary and not intended to be all-inclusive or limiting of possible values that may be used. Since the oxygen sensor's signal varies with battery voltage it may be desirable to compensate the ECU switch points accordingly. The ECU switch points are the voltage levels that the ECU 30 uses to determine if it should start enriching or enleaning the air/fuel ratio to maintain a desired ratio (for example, lambda=1).

Though the fuel pump assembly 10 and the fuel supply system 12 are described as having certain constructions, arrangements, and operations, these may all vary. For example, some components, such as valves, may be added to the system; some components, such as the fuel pump, may be modified; and some components, such as one of the pick-up assemblies, may be taken away or added. In this regard, the exact construction, arrangement, and operation may depend on the fuel requirements of the associated engine, the fuel tank design, and a number of other factors.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A method of retrofitting an engine designed for use with a carbureted fuel supply system for use with a fuel injection fuel supply system, comprising:

attaching an engine temperature sensor to an exterior of the engine having an output signal indicative of the engine temperature;

providing an oxygen sensor in communication with an exhaust circuit of the engine where the oxygen sensor has an output signal indicative of the oxygen content of exhaust gases from the engine;

providing a throttle body with a throttle valve to control air flow to the engine;

providing a fuel injector to control fuel flow to the engine.

2. The method of claim 1 wherein the fuel injector is carried by the throttle body so that fuel and air are delivered from the throttle body to the engine.

3. The method of claim 1 wherein the engine includes an electronic control unit and the operation of at least one of the throttle valve and the fuel injector is controlled by the throttle body as a function of a signal provided by at least one of the oxygen sensor and the temperature sensor.

4. The method of claim 1 wherein the step of attaching an engine temperature sensor is accomplished without forming a void in any portion of the engine.

5. A method of operating an engine used with a fuel system having an engine position or speed sensor and an ignition module, the method comprising:

detecting engine rotation with the engine position or speed sensor;

determining the time period for engine revolutions;

comparing the time period for one engine revolution to the time period of the previous engine revolution;

determining a compression stroke from an exhaust stroke based on the compared engine revolution time periods; and providing an ignition signal from the ignition module during the compression stroke and not during the exhaust stroke.

6. The method of claim 5 which also includes a fuel injector and wherein the fuel injector timing is controlled as a function of the determined compression and exhaust strokes.

7. The method of claim 5 which also includes an engine temperature sensor and wherein predetermined data relating to engine temperature at initial engine operation is used to adjust the flow rate of fuel delivered to the engine so the engine will be provided with a richer than normal air/fuel mixture for initial engine operation.

8. The method of claim 7 wherein after starting the engine, the number of engine revolutions immediately after the engine has started are determined and a predetermined enriched air/fuel mixture is provided to the engine based on the temperature, the number of engine revolutions and the predetermined data.

9. The method of claim 7 wherein the enrichment of the air/fuel mixture decreases to zero after 500 engine revolutions or less.

10. The method of claim 5 wherein the step of comparing the time period for an engine revolution to the time period for a previous engine revolution is performed until a predetermined number of consecutive cycles yields the same engine revolution to be indicative of the compression stroke to ensure the determination of the compression and exhaust strokes is correct before an ignition signal associated with the exhaust stroke is eliminated.

11. A method of operating an engine used with a fuel system having an oxygen sensor and an engine control unit in communication with the exhaust sensor, the method comprising:

providing a predetermined air/fuel mixture to the engine;

providing a signal from the oxygen sensor to the engine control unit indicative of the oxygen content of exhaust gas discharged from the engine;

adjusting the air/fuel mixture provided to the engine to achieve a signal from the oxygen sensor denoted lambda;

comparing the actual air/fuel mixture needed to achieve lambda=1 to the predetermined air/fuel mixture to determine a correction value;

utilizing the correction value to alter the air/fuel mixture actually delivered to the engine from the predetermined air/fuel mixture for given operating conditions.

12. The method of claim 11 wherein the air/fuel mixture is varied in operation of the engine to vary lambda both above and below lambda=1.

13. The method of claim 12 wherein lambda is varied between 0.97 and 1.03.

* * * * *